US010634302B2

(12) United States Patent
Yamamoto

(10) Patent No.: US 10,634,302 B2
(45) Date of Patent: Apr. 28, 2020

(54) VEHICLE LAMP

(71) Applicant: KOITO MANUFACTURING CO., LTD., Tokyo (JP)

(72) Inventor: Ippei Yamamoto, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 42 days.

(21) Appl. No.: 16/001,383

(22) Filed: Jun. 6, 2018

(65) Prior Publication Data

US 2018/0356064 A1 Dec. 13, 2018

(30) Foreign Application Priority Data

Jun. 7, 2017 (JP) ..... 2017-113019

(51) Int. Cl.

| | |
|---|---|
| ***F21S 41/36*** | (2018.01) |
| ***F21S 41/147*** | (2018.01) |
| ***F21S 41/663*** | (2018.01) |
| ***F21S 41/20*** | (2018.01) |
| ***F21S 41/32*** | (2018.01) |
| ***F21S 41/19*** | (2018.01) |
| ***F21S 41/33*** | (2018.01) |
| ***F21S 41/148*** | (2018.01) |
| ***F21S 41/43*** | (2018.01) |

(Continued)

(52) U.S. Cl.

CPC ..... *F21S 41/36* (2018.01); *F21S 41/147* (2018.01); *F21S 41/148* (2018.01); *F21S 41/19* (2018.01); *F21S 41/285* (2018.01); *F21S 41/321* (2018.01); *F21S 41/336* (2018.01); *F21S 41/43* (2018.01); *F21S 41/663* (2018.01); *F21W 2102/13* (2018.01); *F21W 2102/19* (2018.01)

(58) Field of Classification Search

CPC ..... F21S 41/147; F21S 41/148; F21S 41/36; F21S 41/33; F21S 41/334; F21S 41/336; F21S 41/337

See application file for complete search history.

(56) References Cited

U.S. PATENT DOCUMENTS

2008/0225540 A1* 9/2008 Tsukamoto ..... F21V 13/04 362/514

2009/0310353 A1* 12/2009 Inaba ..... F21S 41/147 362/235

(Continued)

FOREIGN PATENT DOCUMENTS

JP 2016-72017 A 5/2016

*Primary Examiner* — Zheng Song

(74) *Attorney, Agent, or Firm* — Sughrue Mion, PLLC

(57) ABSTRACT

A vehicle lamp includes a light source, and a reflector which reflects light emitted from the light source to form a low-beam light distribution pattern. The light source includes first and second light emitting elements. The reflector includes a first reflecting surface which reflects light emitted from the first light emitting element to form a first light distribution pattern configuring a part of the low-beam light distribution pattern, and a second reflecting surface which reflects light emitted from the second light emitting element to form a second light distribution pattern for enhancing brightness of a lower vicinity region of a cut-off line on an oncoming vehicle lane side. The second reflecting surface is arranged in a surface normal direction of a light emitting surface of the second light emitting element on a front side of the first reflecting surface.

10 Claims, 9 Drawing Sheets

(51) Int. Cl.
*F21W 102/13* (2018.01)
*F21W 102/19* (2018.01)

(56) References Cited

U.S. PATENT DOCUMENTS

| | | | | |
|---|---|---|---|---|
| 2013/0003400 | A1* | 1/2013 | Kijima | F21S 41/14 362/517 |
| 2014/0133169 | A1* | 5/2014 | Schwaiger | F21K 9/00 362/516 |
| 2014/0362572 | A1* | 12/2014 | Sun | F21V 29/89 362/245 |
| 2016/0091161 | A1 | 3/2016 | Naganawa | |
| 2016/0097505 | A1* | 4/2016 | Kinouchi | F21S 41/147 362/509 |

* cited by examiner

VEHICLE LAMP

CROSS-REFERENCE TO RELATED APPLICATIONS

The present application claims the benefit of priority of Japanese Patent Application No. 2017-113019, filed on Jun. 7, 2017, the content of which is incorporated herein by reference.

TECHNICAL FIELD

Aspects of the present invention relate to a vehicle lamp configured such that light emitted from a light source is reflected toward a front of the lamp by a reflector so as to form a low-beam light distribution pattern.

BACKGROUND

There has been known a vehicle lamp in which light emitted from a light source is reflected toward a front of the lamp by a reflector so as to form a low-beam light distribution pattern.

JP-A-2016-72017 describes a vehicle lamp in which a light source includes a first light emitting element and a second light emitting element which is arranged at a lamp front side of the first light emitting element.

The vehicle lamp described in JP-A-2016-72017 is configured such that a light distribution pattern configuring a part of a low-beam light distribution pattern is formed by turning on the first light emitting element, and a light distribution pattern configuring a part of a high-beam light distribution pattern is formed by turning on the second light emitting element.

It is desired to enhance brightness of a lower vicinity region of a cut-off line on an oncoming vehicle lane side in the low-beam light distribution pattern so as to improve forward visibility when a vehicle travels on a curved path curved toward the oncoming vehicle lane side with a low beam.

In the vehicle lamp described in JP-A-2016-72017, when forming the light distribution pattern configuring a part of the low-beam light distribution pattern by turning on the first light emitting element, it is conceivable to use a part of a reflecting surface of the reflector as a dedicated region for enhancing the brightness of the lower vicinity region of the cut-off line on the oncoming vehicle lane side.

In this case, if a reflecting region in the reflecting surface of the reflector which is positioned in a surface normal direction of a light emitting surface of the first light emitting element is used as the dedicated region, a light distribution pattern for enhancing the brightness of the lower vicinity region of the cut-off line on the oncoming vehicle lane side can be formed as a bright light distribution pattern.

However, since such a reflecting region is positioned relatively closer to the first light emitting element, a light source image formed by the reflected light becomes large and the light distribution pattern also has a large vertical width. For this reason, it is difficult to form the light distribution pattern for enhancing the brightness of the lower vicinity region of the cut-off line on the oncoming vehicle lane side as a light distribution pattern having a small vertical width, and it is difficult to finely control a forming position thereof. Therefore, it is difficult to improve the forward visibility when a vehicle travels on a curved path curved toward the oncoming vehicle lane side, without giving glare to a driver of an oncoming vehicle.

Meanwhile, if a reflecting region positioned near a front end edge of the reflecting surface of the reflector were used as the dedicated region, the reflecting region would be positioned farthest from the first light emitting element, so that it is possible to form a small light source image by the reflected light. Therefore, the light distribution pattern for enhancing the brightness of the lower vicinity region of the cut-off line on the oncoming vehicle lane side can be formed as a light distribution pattern having a small vertical width.

However, since such a reflecting region is positioned greatly away from the surface normal direction of the light emitting surface of the first light emitting element, and a sufficient amount of reflected light cannot be obtained, it is still difficult to improve the forward visibility when a vehicle travels on the curved path curved toward the oncoming vehicle lane side.

SUMMARY

The present invention has been made in view of the above circumstances, and an aspect of the present invention provides a vehicle lamp which is configured such that light emitted from a light source is reflected toward a front of a vehicle by a reflector so as to form a low-beam light distribution pattern and can improve forward visibility when a vehicle travels on a curved path curved toward an oncoming vehicle lane side.

An aspect of the present invention provides a vehicle lamp including the first and second light emitting elements in which the arrangement of the first and second light emitting elements and a configuration of a reflector are designed.

That is, according to an embodiment of the present invention, there is provided a vehicle lamp includes a light source and a reflector which is configured to reflect light emitted from the light source toward a front of the lamp so as to form a low-beam light distribution pattern. The light source includes a first light emitting element and a second light emitting element which is arranged at a lamp front side of the first light emitting element. The reflector includes a first reflecting surface which is configured to reflect light emitted from the first light emitting element so as to form a first light distribution pattern configuring at least a part of the low-beam light distribution pattern, and a second reflecting surface which is configured to reflect light emitted from the second light emitting element so as to form a second light distribution pattern for enhancing brightness of a lower vicinity region of a cut-off line on an oncoming vehicle lane side in the low-beam light distribution pattern. The second reflecting surface is arranged in a surface normal direction of a light emitting surface of the second light emitting element on a lamp front side of the first reflecting surface.

In the above, types of the "first light emitting element and second light emitting element" are not particularly limited, and for example, a light emitting diode, a laser diode, or the like may be adopted.

A specific positional relationship between the "second light emitting element" and the first light emitting element is not particularly limited as long as the "second light emitting element" is arranged at the vehicle front side of the first light emitting element.

Specific sizes of the "first reflecting surface and second reflecting surface" and shapes of the reflecting surfaces are not particularly limited.

The configuration of the "second reflecting surface is arranged in a surface normal direction of a light emitting surface of the second light emitting element" may refer to that the "second reflecting surface" includes a point positioned in the surface normal direction of the light emitting surface of the second light emitting element.

The "first light distribution pattern" may be a light distribution pattern in which a low-beam light distribution pattern is formed by superposing a second light distribution pattern on the "first light distribution pattern", and may also be a light distribution pattern in which a low-beam light distribution pattern is formed by superposing a second light distribution pattern and another light distribution pattern on the "first light distribution pattern".

According to the above configuration, the vehicle lamp includes the light source and the reflector. The light source includes the first light emitting element and the second light emitting element which is arranged at the lamp front side of the first light emitting element. Further, the reflector includes the first reflecting surface which reflects light emitted from the first light emitting element so as to form the first light distribution pattern configuring at least a part of the low-beam light distribution pattern, and the second reflecting surface which reflects light emitted from the second light emitting element so as to form the second light distribution pattern for enhancing brightness of the lower vicinity region of the cut-off line on the oncoming vehicle lane side in the low-beam light distribution pattern. The second reflecting surface is arranged in the surface normal direction of the light emitting surface of the second light emitting element on the lamp front side of the first reflecting surface. Therefore the following operational effect can be obtained.

That is, the second reflecting surface is arranged in the surface normal direction of the light emitting surface of the second light emitting element, so that the second light distribution pattern can be formed as a bright light distribution pattern. Then, since the second reflecting surface is positioned on the lamp front side of the first reflecting surface and is positioned farther from the second light emitting element, the second light distribution pattern can be formed as a light distribution pattern having a small vertical width.

Further, since the second light distribution pattern is formed as a light distribution pattern which is bright and has a small vertical width, forward visibility when a vehicle travels on a curved path curved toward an oncoming vehicle lane side can be improved.

According to the above configuration, the vehicle lamp is configured such that the light emitted from the light source is reflected toward the front of the lamp by the reflector so as to form the low-beam light distribution pattern and can improve the forward visibility when a vehicle travels on a curved path curved toward an oncoming vehicle lane side.

In the above configuration, if the vehicle lamp includes a first light shielding member which blocks light emitted from the second light emitting element to be incident on the first reflecting surface, it is possible to reduce or eliminate possibility that a part of the light emitted from the second light emitting element is reflected by the first reflecting surface to generate stray light which causes glare, uneven light distribution, or the like.

In the above configuration, if the vehicle lamp includes a second light shielding member which blocks light emitted from the first light emitting element to be incident on the second reflecting surface, it is possible to reduce or eliminate possibility that a part of the light emitted from the first light emitting element is reflected by the second reflecting surface to generate stray light which causes glare, uneven light distribution, or the like.

In the above configuration, if the second light emitting element is arranged to be displaced in a direction away from the reflector with respect to the first light emitting element, a longer distance from the second light emitting element to the second reflecting surface can be ensured, so that the second light distribution pattern can be formed as a light distribution pattern having a small vertical width more easily, and therefore, the forward visibility when a vehicle travels on a curved path curved toward an oncoming vehicle lane side can be further improved.

In the above configuration, if each of the first reflecting surface and the second reflecting surface are both formed based on a paraboloid surface as a reference surface, and the second reflecting surface is formed based on a paraboloid surface whose focal distance is longer than that of the first reflecting surface as a reference surface, the reflection of the light emitted from the first light emitting element by the first reflecting surface and the reflection of the light emitted from the second light emitting element by the second reflecting surface can be controlled with high precision, and the second light distribution pattern can be easily formed as a light distribution pattern having a small vertical width with high positional precision by the light reflected from the second reflecting surface.

BRIEF DESCRIPTION OF DRAWINGS

FIGS. 3A and 3B are perspective views showing a low-beam light distribution pattern formed by light irradiated from the vehicle lamp, wherein FIG. 3A shows a low-beam light distribution pattern when a vehicle travels on a straight path, and FIG. 3B shows a low-beam light distribution pattern when the vehicle travels on a curved path curved toward an oncoming vehicle lane side.

DESCRIPTION OF EMBODIMENTS

Hereinafter, embodiments of the present invention will be described with reference to the drawings.

Figure 1:
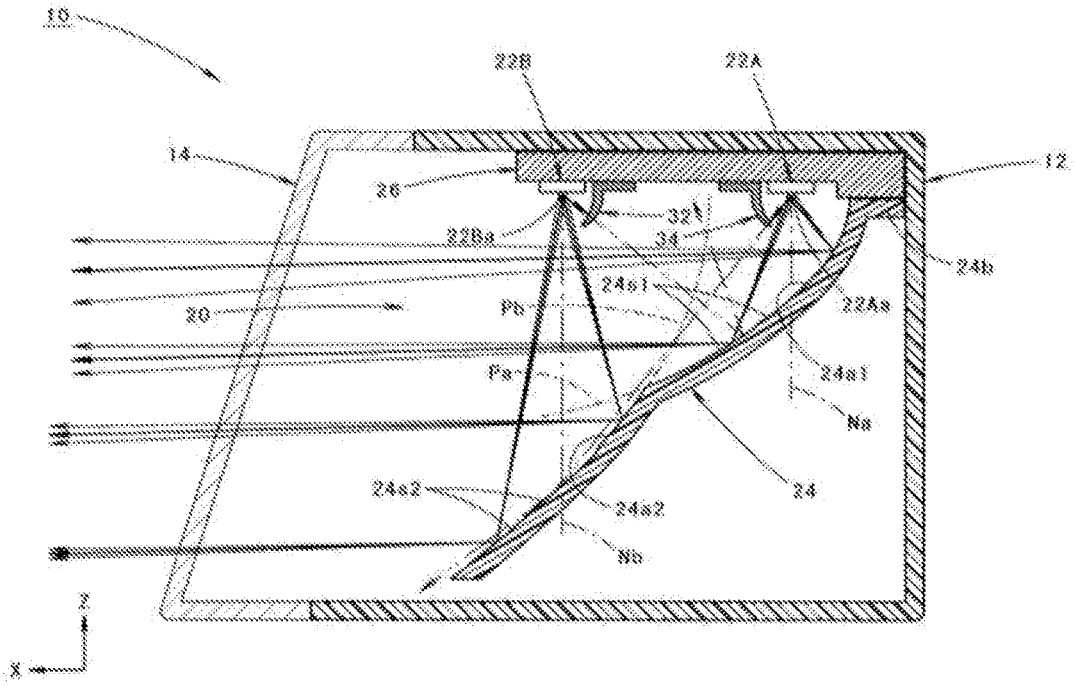
FIG. 1 is a side cross-sectional view of a vehicle lamp according to an embodiment of the present invention.
Figure 2:
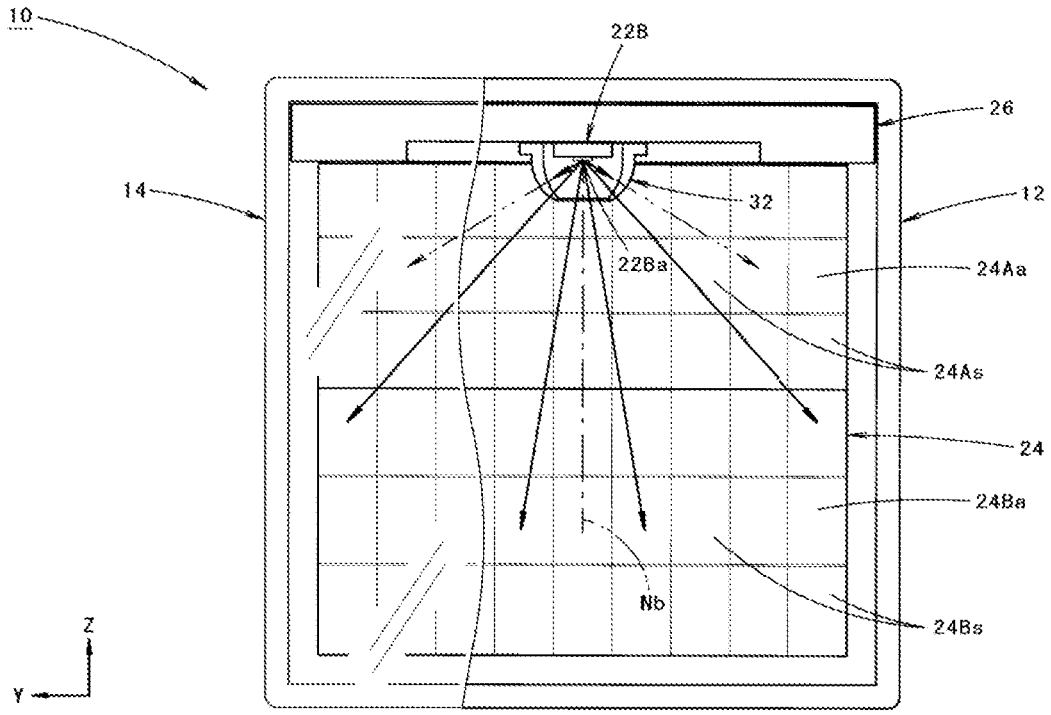
FIG. 2 is a front view of the vehicle lamp.

FIG. 1 is a side cross-sectional view showing a vehicle lamp 10 according to an embodiment of the present invention, and FIG. 2 is a front view of the vehicle lamp.

As shown in FIGS. 1 and 2, the vehicle lamp 10 according to the embodiment is configured such that a lamp unit 20 is accommodated in a lamp chamber formed by a lamp body 12 and a light-transmitting cover 14 which is attached to a front end opening of the lamp body 12.

Incidentally, in these drawings, a direction indicated by X is a lamp "front side (also a vehicle "front side"), a direction indicated by Y is a "right side", and a direction indicated by Z is an "upper side".

The lamp unit 20 includes a first light emitting element 22A, a second light emitting element 22B which is arranged at a front side of the first light emitting element 22A, and a reflector 24 which reflects light emitted from the first light emitting element 22A and the second light emitting element 22B toward a front side thereof.

The first light emitting element 22A and the second light emitting element 22B each includes a white-light emitting diode having a light emitting surface 22Aa, 22Ba with a horizontally elongated rectangular shape.

The first and second light emitting elements 22A, 22B are supported on a lower surface of a common substrate 26 at the same height position with light emitting surfaces 22Aa, 22Ba thereof facing directly downward. The substrate 26 has a function of a heat sink and is supported by the lamp body 12.

The reflector 24 is arranged at a lower side of the first and second light emitting elements 22A, 22B and is supported on a lower surface of the substrate 26 at a horizontal flange portion 24*b* formed at an upper end edge of a rear portion of the reflector 24. The lower surface of the substrate 26 is formed such that the portion supporting the horizontal flange portion 24*b* is one step lower than the other portions.

The reflector 24 includes a first reflecting surface 24*a*1 and a second reflecting surface 24*a*2 which is positioned at a front side of the first reflecting surface 24*a*1.

The first reflecting surface 24*a*1 is arranged so as to be positioned in a surface normal direction Na of the light emitting surface 22Aa of the first light emitting element 22A, and the second reflecting surface 24*a*2 is arranged so as to be positioned in a surface normal direction Nb of the light emitting surface 22Ba of the second light emitting element 22B.

The reflector 24 has a rectangular outer shape close to a square in a front view of the lamp and is configured such that a lower end edge of the first reflecting surface 24*a*1 and an upper end edge of the second reflecting surface 24*a*2 are connected at a middle position in an upper-lower direction (specifically, a substantially center position in the upper-lower direction) of the reflector.

The first reflecting surface 24*a*1 is configured such that a reflecting element 24*s*1 is arranged to each of a plurality of segments which are partitioned laterally and longitudinally into a lattice shape in the front view of the lamp. The reflecting element 24*s*1 is configured by a concave curved surface with a paraboloid of revolution Pa as a reference surface. The paraboloid of revolution Pa has a focal point at a light emitting center of the first light emitting element 22A and has a center axis extending along a front-rear direction of the lamp.

Further, the first reflecting surface 24*a*1 is set to control reflection of light emitted from the first light emitting element 22A in each reflecting element 24*s*1 so as to form a first light distribution pattern (described later) configuring a main portion of a low-beam light distribution pattern (described later).

The second reflecting surface 24*a*2 is configured such that a reflecting element 24*s*2 is arranged to each of a plurality of segments which are partitioned laterally and longitudinally into a lattice shape in the front view of the lamp. The reflecting element 24*s*2 is configured by a concave curved surface with a paraboloid of revolution Pb as a reference surface. The paraboloid of revolution Pb has a focal point at a light emitting center of the second light emitting element 22B and has a central axis extending along the front-rear direction of the lamp.

A focal distance of the paraboloid of revolution Pb serving as the reference surface of the second reflecting surface 24*a*2 is set to be longer than (for example, twice or more) that of the paraboloid of revolution Pa serving as the reference surface of the first reflecting surface 24*a*1.

Further, the second reflecting surface 24*a*2 is set to control reflection of light emitted from the second light emitting element 22B in each reflecting element 24*s*2 so as to form a second light distribution pattern (described later) for enhancing brightness of a lower vicinity region of a cut-off line on an oncoming vehicle lane side in the low-beam light distribution pattern.

A first light shielding member 32 is arranged near a rear of the second light emitting element 22B so as to prevent light emitted from the second light emitting element 22B from being incident on the first reflecting surface 24*a*1. The first light shielding member 32 is supported on the lower surface of the substrate 26 to cover the second light emitting element 22B from a rear side thereof.

A second light shielding member 34 is arranged near a front of the first light emitting element 22A so as to prevent light emitted from the first light emitting element 22A from being incident on the second reflecting surface 24*a*2. The second light shielding member 34 is supported on the lower surface of the substrate 26 to cover the first light emitting element 22A from a front side thereof.

Figure 3A:
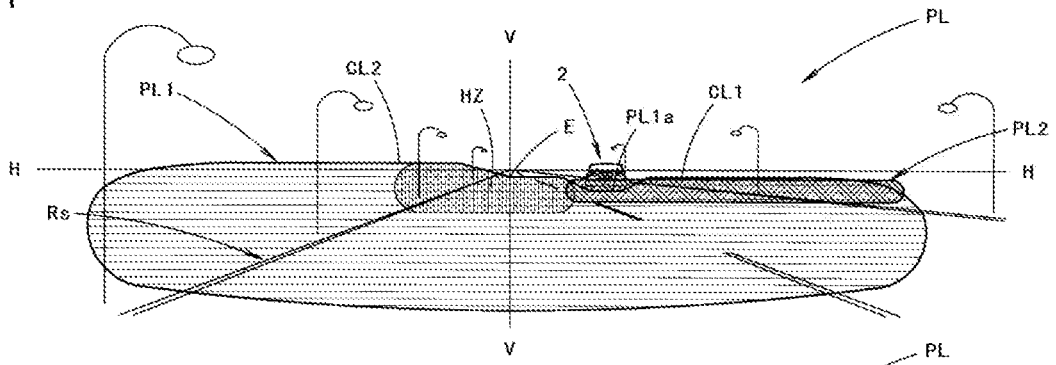
Figure 3B:
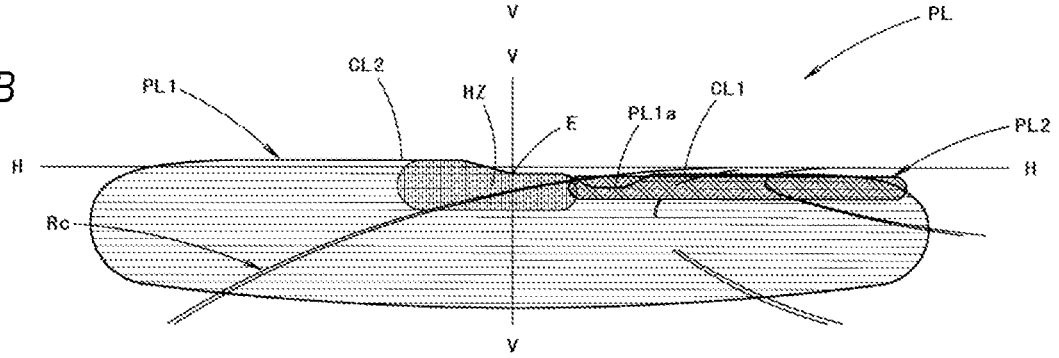

FIGS. 3A and 3B are perspective views showing a low-beam light distribution pattern PL formed on a virtual vertical screen arranged at a position 25 m in front of the vehicle lamp 10 by light irradiated from the lamp.

FIG. 3A shows a low-beam light distribution pattern when a vehicle travels on a straight path Rs, and FIG. 3B shows a low-beam light distribution pattern when a vehicle travels on a curved path Rc curved toward an oncoming vehicle lane side (that is a right side).

The low-beam light distribution pattern PL is formed as a low-beam light distribution pattern for left light distribution having cut-off lines CL1, CL2 at an upper edge thereof.

The low-beam light distribution pattern PL is formed as a light distribution pattern synthesized by a first light distribution pattern PL1 formed by light reflected from the first reflecting surface 24*a*1 and a second light distribution pattern PL2 formed by light reflected from the second reflecting surface 24*a*2.

The cut-off lines CL1, CL2 extend in the horizontal direction in a left-right stepped manner and are bounded by a line V-V which extends in a vertical direction to pass a vanishing point (i.e. H-V) in a lamp front direction. A portion on an oncoming vehicle lane side which is right of the line V-V is formed as a lower step cut-off line CL1, and a portion on an own vehicle lane side which is left of the line V-V is formed as an upper step cut-off line CL2, which is a step higher than the lower step cut-off line CL1 via an inclined portion.

In the low-beam light distribution pattern PL, an elbow point E which is an intersection point of the lower step cut-off line CL1 and the line V-V, is positioned 0.5° to 0.6° below the H-V. Further, in this low-beam light distribution pattern PL, a horizontally long region which surrounds the elbow point E and is slightly close to the left side is formed as a high luminous intensity region HZ.

The first light distribution pattern PL1 is a light distribution pattern configuring a main portion of the low-beam light distribution pattern PL, and the cut-off lines CL1, CL2 are formed by the first light distribution pattern PL1.

The second light distribution pattern PL2 is formed as a light distribution pattern for enhancing brightness of a lower vicinity region of the lower step cut-off line CL1 on the oncoming vehicle lane side in the low-beam light distribution pattern PL.

A part of the portion configuring the lower step cut-off line CL1 of first light distribution pattern PL1 is formed as a recessed portion PL1*a*. The recessed portion PL1*a* is formed to be recessed substantially in a trapezoidal shape with respect to the lower step cut-off line CL1 near a right side of the high luminous intensity region HZ.

The second light distribution pattern PL2 is formed as a bright light distribution pattern which extends in the horizontal direction in the lower vicinity of the lower step cut-off line CL1 and has a small vertical width. The second light distribution pattern PL2 is formed to fill the recessed portion PL1*a* of the first light distribution pattern PL1 near a left end portion of the second light distribution pattern PL2 while being partially overlapped with the high luminous intensity region HZ at the left end portion of the second light distribution pattern PL2. Therefore, the low-beam light distribution pattern PL is formed as a bright light distribution pattern in the lower vicinity region of the lower step cut-off line CL1 except for the recessed portion PL1*a*.

As shown in FIG. 3A, when the own vehicle travels on the straight path Rs, the low-beam light distribution pattern PL is configured not to give intense glare to a driver of an oncoming vehicle 2 due to the presence of the recessed portion PL1*a* even in a case where the own vehicle is slightly pitching, and as shown in FIG. 3B, the low-beam light distribution pattern PL sufficiently ensures the forward visibility when the vehicle travels on the curved path Rc curved toward the oncoming vehicle lane side (that is, the right side).

Figure 4A:
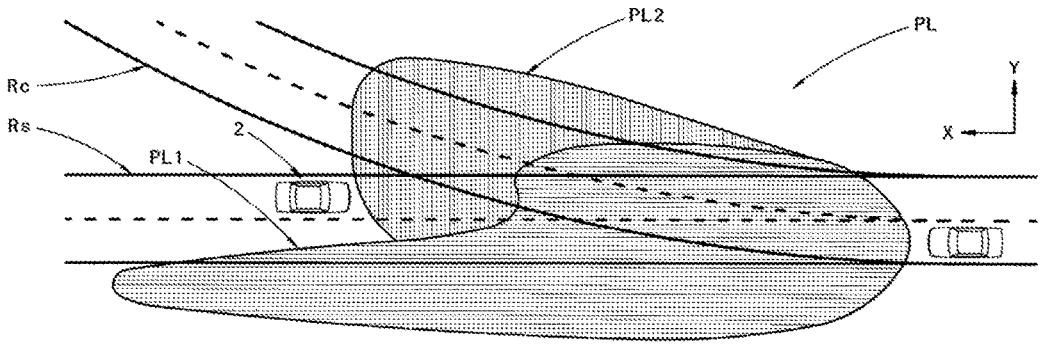
FIG. 4A is a view showing the low-beam light distribution pattern as seen from above.

FIG. 4A is a view showing the low-beam light distribution pattern PL as seen from above.

The straight path Rs and the curved path Rc are superposed in FIG. 4A.

As shown in FIG. 4A, the low-beam light distribution pattern PL is formed such that the second light distribution pattern PL2 extends rightward and forward largely with respect to the first light distribution pattern PL1 configuring the main portion of the low-beam light distribution pattern PL.

Figure 4B:
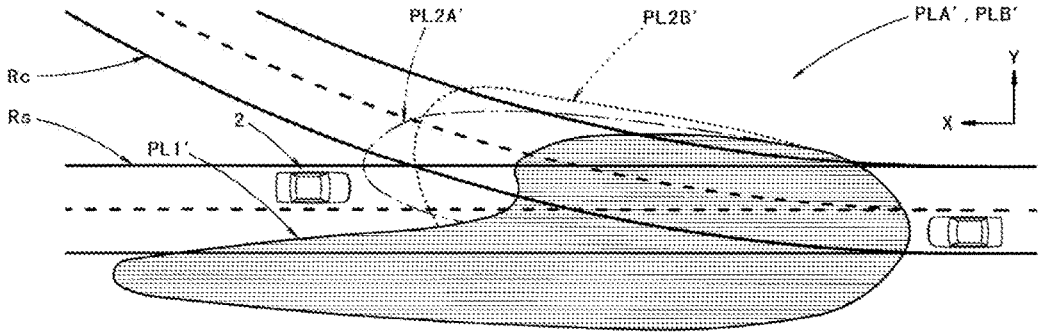
FIG. 4B is a view showing two types of low-beam light distribution patterns formed by light irradiated from a related-art vehicle lamp as seen from above.
Figure 5:
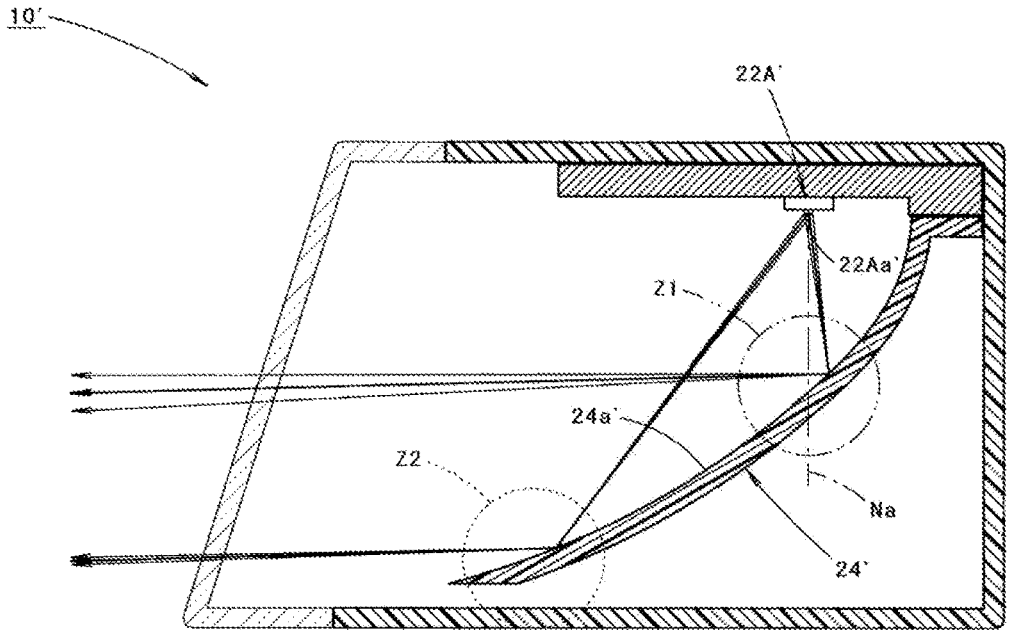
FIG. 5 is a view similar to FIG. 1 and shows a related-art vehicle lamp.

FIG. 4B is a view similar to FIG. 4A and shows two types of low-beam light distribution patterns PLA', PLB' formed by light irradiated from a related-art vehicle lamp 10' shown in FIG. 5.

The related-art vehicle lamp 10' shown in FIG. 5 is configured such that light emitted from a first light emitting element 22A' is reflected toward a front of the lamp by a reflector 24' so as to form the low-beam light distribution patterns PLA', PLB'.

Figure 6A:
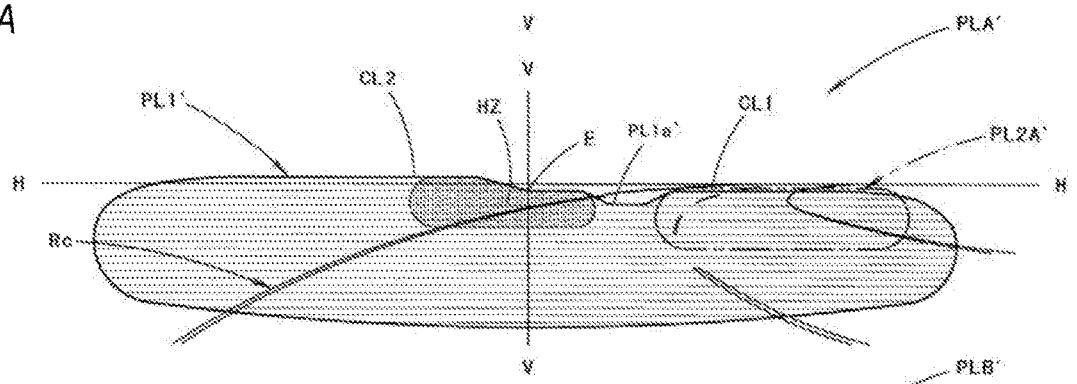
FIGS. 6A and 6B are views similar to FIGS. 3A and 3B and show the two types of low-beam light distribution patterns separately.
Figure 6B:
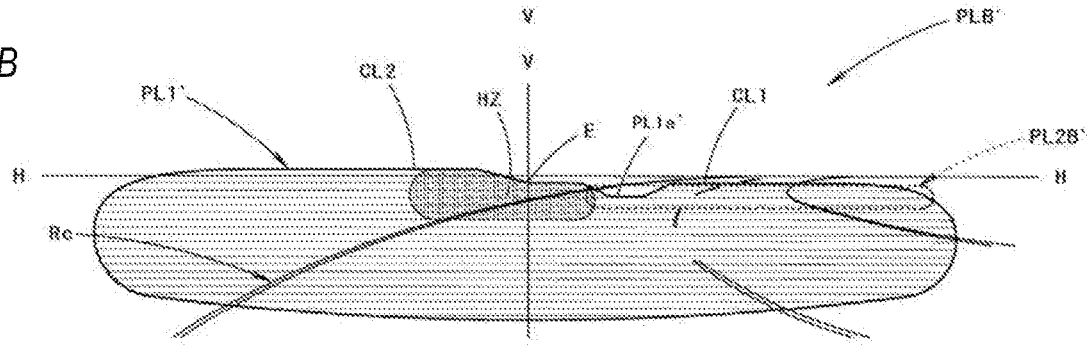

FIGS. 6A and 6B are views similar to FIGS. 3A and 3B and show the two types of low-beam light distribution patterns PLA', PLB' separately.

In FIG. 4B and FIGS. 6A and 6B, the light distribution pattern PL2A' indicated by a two-dot chain line and the light distribution pattern PL2B' indicated by a broken line are light distribution patterns corresponding to the second light distribution pattern PL2 of the embodiment of the present invention.

The light distribution pattern PL2A' is a light distribution pattern formed in a case where a reflecting region (a reflecting region Z1 surrounded by a two-dot chain line in the figure) in a reflecting surface 24*a*' of a reflector 24' which is positioned in a surface normal direction Na of a light emitting surface 22Aa' of a first light emitting element 22A', is used as a dedicated region for enhancing the brightness of the lower vicinity region of the cut-off line CL1 on the oncoming vehicle lane side.

Although the light distribution pattern PL2A' is formed to extend and project rightward and forward with respect to a light distribution pattern PL1' corresponding to the first light distribution pattern PL1 of the embodiment, a horizontal width of the light distribution pattern PL2A' is considerably smaller than that of the second light distribution pattern PL2 of the embodiment of the present invention.

Since the light distribution pattern PL2A' formed by light reflected form the reflecting region Z1 has a large vertical width, it is not easy to finely control a forming position thereof, and therefore, it is necessary to form the light distribution pattern PL2A' at a position which does not give glare to the driver of the oncoming vehicle 2 by irradiating light upward above the lower step cut-off line CL1 in a recessed portion PL1*a'*.

The light distribution pattern PL2B' is a light distribution pattern formed in a case where a reflecting region (a reflecting region Z2 surrounded by a broken line in the figure) which is positioned close to a front end edge of the reflecting surface 24*a*' of the reflector 24' is used as a dedicated region for enhancing the brightness of the lower vicinity region of cut-off line CL1 on the oncoming vehicle lane side.

Although the light distribution pattern PL2B' is formed to extend and project rightward and forward with respect to the light distribution pattern PL1', a forward projection amount of the light distribution pattern PL2B' is considerably smaller than that of the second light distribution pattern PL2 of the embodiment of the present invention.

The reason is that a sufficient amount of reflected light cannot be obtained from the reflecting region Z2, so that the light distribution pattern PL2B' cannot be formed as a bright light distribution pattern.

Next, an operational effect of the embodiment will be described.

The vehicle lamp 10 according to the embodiment includes the light source and the reflector 24. The light source includes the first light emitting element 22A and the second light emitting element 22B which is arranged at the lamp front side of the first light emitting element 22A. The reflector 24 includes the first reflecting surface 24*a*1 which reflects the light emitted from the first light emitting element 22A so as to form the first light distribution pattern PL1 configuring the main portion (that is, at least a part) of the low-beam light distribution pattern PL, and the second reflecting surface 24*a*2 which reflects the light emitted from the second light emitting element 22B so as to form the second light distribution pattern PL2 for enhance the brightness of the lower vicinity region of the cut-off line CL1 (that is, the cut-off line on the oncoming vehicle lane side) of the low-beam light distribution pattern PL. The second reflecting surface 24*a*2 is arranged in the surface normal direction Nb of the light emitting surface 22Ba of the second light emitting element 22B on the lamp front side of the first reflecting surface 24*a*1. Therefore, the following operational effect can be obtained.

That is, since the second reflecting surface 24*a*2 is arranged in the surface normal direction Nb of the light emitting surface 22Ba of the second light emitting element 22B, the second light distribution pattern PL2 can be formed as a bright light distribution pattern. Then, since the second reflecting surface 24*a*2 is positioned on the lamp front side of the first reflecting surface 24*a*1 and is positioned farther from the second light emitting element 22B, the second light distribution pattern PL2 can be formed as a light distribution pattern having a small vertical width.

Further, since the second light distribution pattern PL2 is formed as a bright light distribution pattern which is bright and has a small vertical width, the forward visibility when a vehicle travels on the curved path Rc curved toward the oncoming vehicle lane side can be improved.

Thus, according to the embodiment, the vehicle lamp 10 is configured such that the light emitted from the light source is reflected toward the front of the lamp by the reflector 24 so as to form the low-beam light distribution pattern and can improve the forward visibility when the vehicle travels on the curved path Rc curved toward the oncoming vehicle lane side.

Since the vehicle lamp 10 according to the embodiment includes the first light shielding member 32 which blocks the light emitted from the second light emitting element 22B to be incident on the first reflecting surface 24*a*1, it is possible to reduce or eliminate the possibility that a part of the light (as indicated by a two-dot chain line in FIG. 1) emitted from the second light emitting element 22B is reflected by the first reflecting surface 24*a*1 to generate stray light which causes glare, uneven light distribution, or the like.

Further, since the vehicle lamp 10 according to the embodiment includes the second light shielding member 34 which blocks the light emitted from the first light emitting element 22A to be incident on the second reflecting surface 24*a*2, it is possible to reduce or eliminate the possibility that a part of the light (as indicated by a two-dot chain line in FIG. 1) emitted from the first light emitting element 22A is reflected by the second reflecting surface 24*a*2 to generate stray light which causes glare, uneven light distribution, or the like.

Since in the reflector 24 of the embodiment, the first reflecting surface 24*a*1 and the second reflecting surface 24*a*2 are both formed based on a paraboloid surface as a reference surface, and the second reflecting surface 24*a*2 is formed based on the paraboloid surface whose focal distance is longer than that of the first reflecting surface 24*a*1 as the reference surface, the reflection of the light emitted from the first light emitting element 22A by the first reflecting surface 24*a*1 and the reflection of the light emitted from the second light emitting element 22B by the second reflecting surface 24*a*2 can be controlled with high precision, and the second light distribution pattern PL2 can be easily formed as a light distribution pattern having a small vertical width with high positional precision by the light reflected from the second reflecting surface 24*a*2.

In the embodiment, since the first light distribution pattern PL1 is formed as a light distribution pattern including the recessed portion PL1*a* in a part of the lower step cut-off line CL1 of the first light distribution pattern PL1, it is possible to reduce or prevent the first light distribution pattern PL1 from giving glare to the driver of the oncoming vehicle 2 due to the presence of the recessed portion PL1*a* even in a case where the own vehicle is slightly pitching.

Incidentally, the first light distribution pattern PL1 may also be a light distribution pattern that does not have the recessed portion PL1*a* in a part of the lower step cut-off line CL1.

In the above embodiment, although there has been described that the reflector 24 is configured such that a portion configuring the first reflecting surface 24*a*1 and a portion configuring the second reflecting surface 24*a*2 are integrally formed, the reflector may also be configured such that the two parts are formed separately.

Although the vehicle lamp 10 according to the above embodiment is configured such that the low-beam light distribution pattern PL is formed by light irradiated from a single lamp unit 20, the vehicle lamp 10 may be configured such that the low-beam light distribution pattern PL is formed by light irradiated from a plurality of lamp units, and in this case a light distribution pattern similar to the second light distribution pattern PL2 may be formed by light irradiated from a part or all of the lamp units.

Next, modifications of the above embodiment will be described.

A first modification of the above embodiment will be described first.

Figure 7:
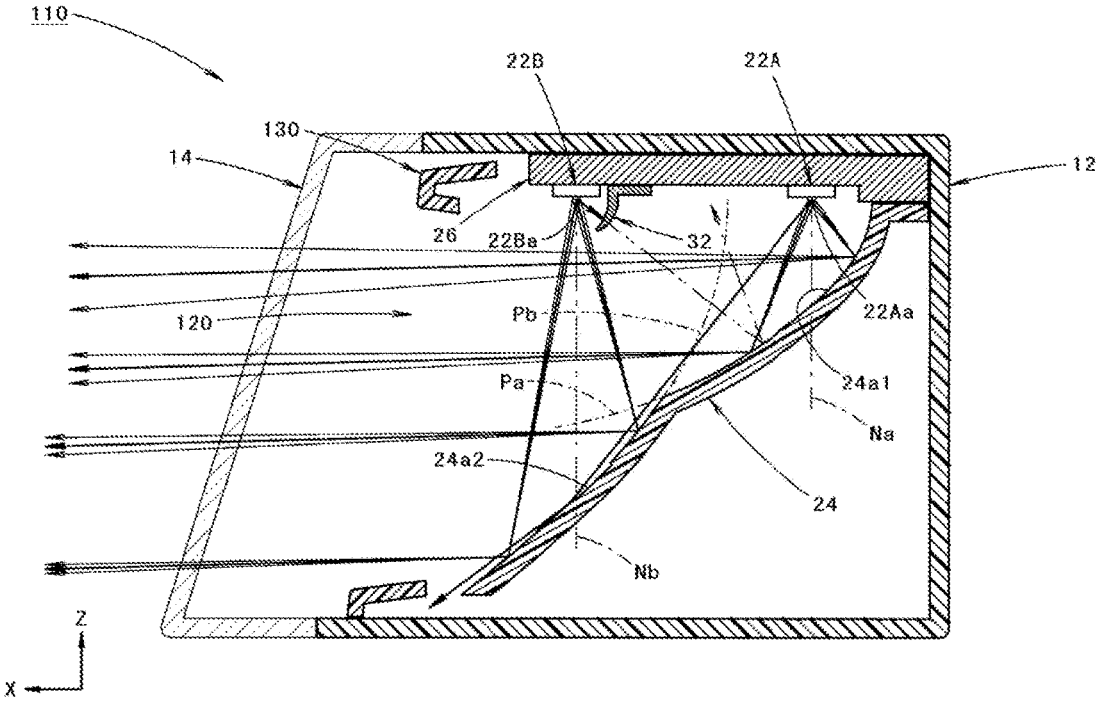
FIG. 7 is a view similar to FIG. 1 and shows a first modification of the embodiment of the present invention.

FIG. 7 is a view similar to FIG. 1 and shows a vehicle lamp 110 according to the first modification.

As shown in FIG. 7, a basic configuration of the vehicle lamp 110 is similar to that of the vehicle lamp 10 according to the above embodiment. The first modification is different in that a lamp unit 120 is not provided with the second light shielding member 34 of the above embodiment, and an extension member 130 formed to surround an outer peripheral edge portion of the reflector 24 and the substrate 26 is arranged near a front of the lamp unit 120.

In the first modification, although a part of light emitted from the first light emitting element 22A is incident on the second reflecting surface 24*a*2, this light reflected from the second reflecting surface 24*a*2 travels toward a rear space of the extension member 130, so that it is possible to reduce or eliminate the possibility of generating stray light which causes glare, uneven light distribution, or the like.

Therefore, when adopting the configuration of the first modification, the same operational effect as in the case of the above embodiment can also be obtained.

Next, a second modification of the above embodiment will be described.

Figure 8:
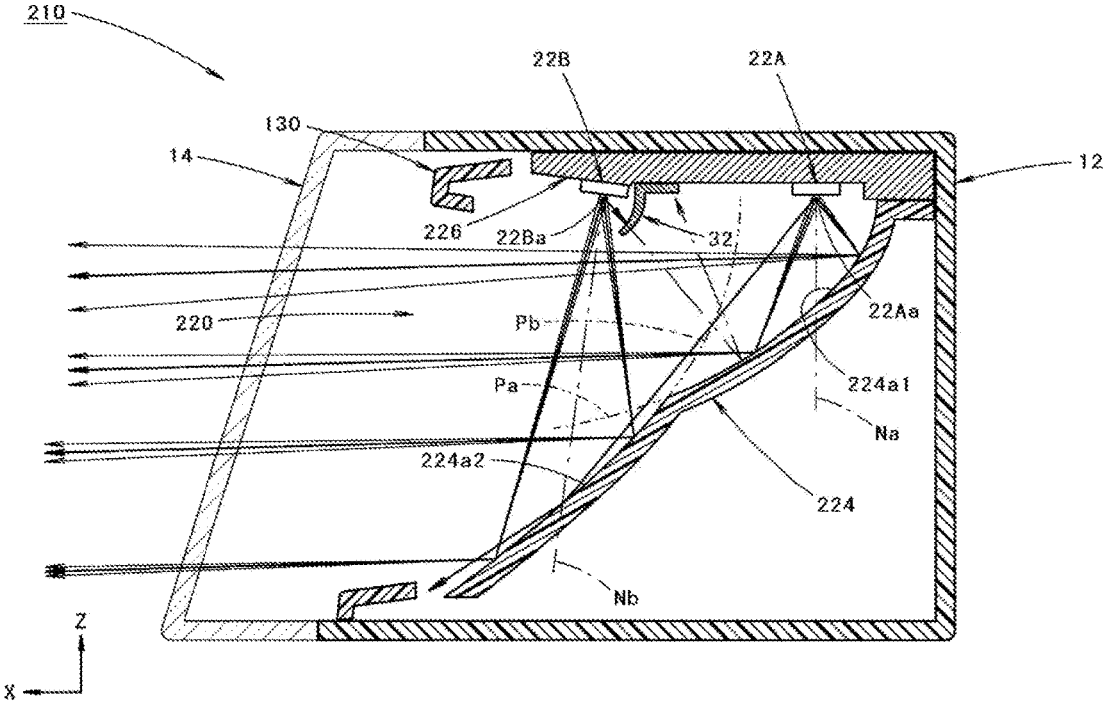
FIG. 8 is a view similar to FIG. 1 and shows a second modification of the embodiment of the present invention.

FIG. 8 is a view similar to FIG. 1 and shows a vehicle lamp 210 according to the second modification.

As shown in FIG. 8, a basic configuration of the vehicle lamp 210 is similar to that of the vehicle lamp 110 according to the above first modification. The second modification is different in that a second light emitting element 22B of a lamp unit 220 is arranged in a state where a light emitting surface 22Ba thereof is directed to a direction inclined slightly to a front side with respect to a directly downward direction.

Thus, a front end portion of a lower surface of a substrate 226 of the second modification is formed into an inclined shape.

In the second modification, since the surface normal direction Nb of the light emitting surface 22Ba of the second light emitting element 22B is inclined to the front side with respect to the directly downward direction, more light emitted from the second light emitting element 22B can be incident on the second reflecting surface 224*a*2, while maintaining the configuration of a first reflecting surface 224*a*1 to be same as the first modification.

Therefore, the second light distribution pattern PL2 can be formed as a brighter light distribution pattern by adopting the configuration of the second modification.

Next, a third modification of the above embodiment will be described.

Figure 9:
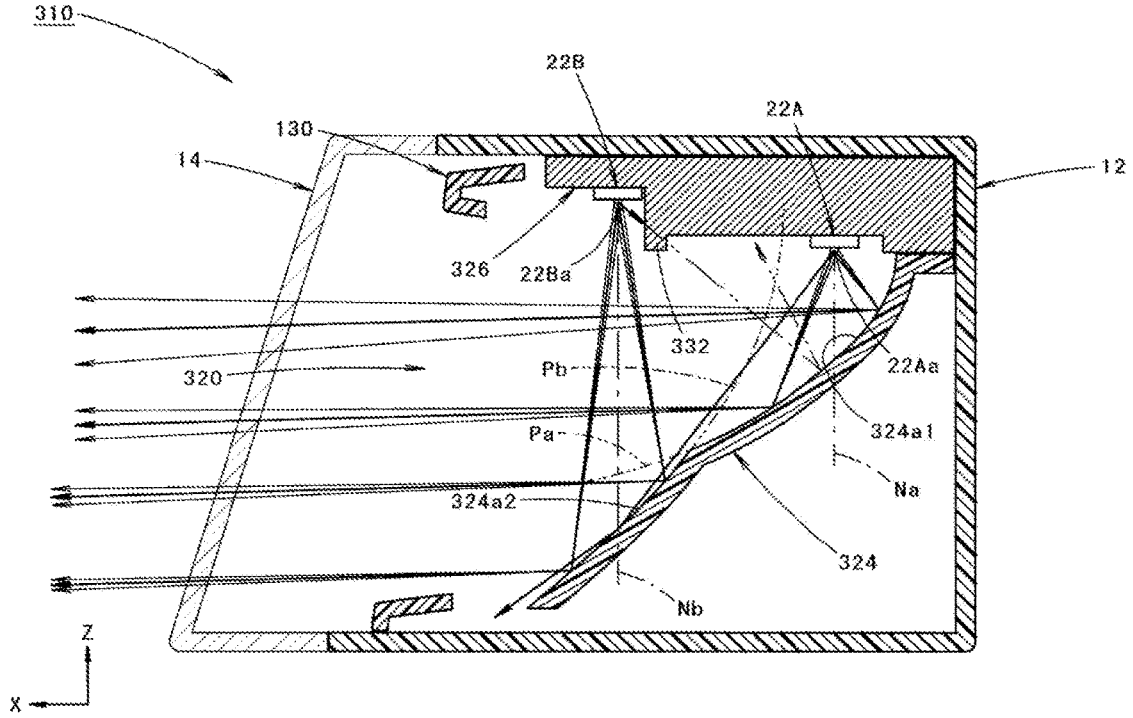
FIG. 9 is a view similar to FIG. 1 and shows a third modification of the embodiment of the present invention.

FIG. 9 is a view similar to FIG. 1 and shows a vehicle lamp 310 according to the third modification.

As shown in FIG. 9, a basic configuration of the vehicle lamp 310 is similar to that of the vehicle lamp 110 according to the above first modification. The third modification is different in that a second light emitting element 22B of a lamp unit 320 is arranged to be displaced in a direction away from a reflector 324 (that is, upward) with respect to the first light emitting element 22A.

Specifically, when compared with the above first modification, although the position of the second light emitting element 22B are the same, the position of the first light emitting element 22A is displaced downward.

Thus, the substrate 326 of the third modification is formed to be thicker than the substrate 26 of the above first modification except for a front end portion.

Further, in the third modification, a first light shielding member 332 which blocks light emitted from the second light emitting element 22B to be incident on a first reflecting surface 324*a*1 is integrally formed with the substrate 326 as a protrusion portion protruding downward from a lower surface of the substrate 326.

Further, in the third modification, a focal distance of the paraboloid of revolution Pb configuring a reference surface of a second reflecting surface 324*a*2 of the reflector 324 is set to a value larger than that in the case of the above first modification, and therefore, a distance from the light emitting surface 22B a of the second light emitting element 22B to the second reflecting surface 324*a*2 is longer than that in the case of the above first modification.

Since the first light emitting element 22A is displaced downward with respect to the second light emitting element 22B in the third modification, the configuration of the first reflecting surface 324*a*1 can be maintained to be same as that in the above first modification even though the focal distance of the paraboloid of revolution Pb is set to a value larger than that in the case of the above first modification.

As in the third modification, since a distance from the light emitting surface 22Ba of the second light emitting element 22B to the second reflecting surface 324*a*2 is set to be longer, the second light distribution pattern PL2 can be formed as a light distribution pattern having a small vertical width more easily.

Further, as in the third modification, since the first light shielding member 332 is integrally formed with the substrate 326, a number of components can be reduced.

Incidentally, numerical values shown as specifications in the above embodiment and modifications thereof are merely examples, and these values may be set to different values as appropriate.

Further, the present invention is not limited to the configurations described in the above embodiment and modifications thereof, and a configuration added with various other changes may be adopted.

The invention claimed is:

1. A vehicle lamp comprising:

a light source; and a reflector which is configured to reflect light emitted from the light source toward a front of the lamp so as to form a low-beam light distribution pattern, wherein the light source including a first light emitting element and a second light emitting element arranged at a lamp front side of the first light emitting element;

wherein the reflector includes:

a first reflecting surface which is configured to reflect light emitted from the first light emitting element so as to form a first light distribution pattern configuring at least a part of the low-beam light distribution pattern; and a second reflecting surface which is configured to reflect light emitted from the second light emitting element so as to form a second light distribution pattern for enhancing brightness of a lower vicinity region of a cut-off line on an oncoming vehicle lane side in the low-beam light distribution pattern, wherein the second reflecting surface is arranged in a surface normal direction of a light emitting surface of the second light emitting element on a lamp front side of the first reflecting surface, the first reflecting surface comprises first reflecting elements that are each arranged to a respective one of a plurality of first segments, which are partitioned laterally and longitudinally into a lattice shape in a front view of the vehicle lamp, each of the first reflecting elements includes a concave curved surface with a first paraboloid of revolution as a reference surface, the first paraboloid of revolution having a focal point at a light emitting center of the first light emitting element and having a center axis extending along a front-rear direction of the vehicle lamp, the second reflecting surface comprises second reflecting elements that are each arranged to a respective one of a plurality of second segments, which are partitioned laterally and longitudinally into a lattice shape in the front view of the vehicle lamp, and each of the second reflecting elements including a concave curved surface with a second paraboloid of revolution as a reference surface, the second paraboloid of revolution having a focal point at a light emitting center of the second light emitting element and having a center axis extending along the front-rear direction of the vehicle lamp.

2. The vehicle lamp according to claim 1, further comprising:

a first light shielding member which is configured to block light from the second light emitting element to be incident on the first reflecting surface.

3. The vehicle lamp according to claim 2, further comprising:

a second light shielding member which is configured to block light from the first light emitting element to be incident on the second reflecting surface.

4. The vehicle lamp according to claim 1, further comprising:

a second light shielding member which is configured to block light from the first light emitting element to be incident on the second reflecting surface.

5. The vehicle lamp according to claim 1, wherein the second light emitting element is arranged to be displaced in a direction away from the reflector with respect to the first light emitting element.

6. The vehicle lamp according to claim 1, wherein each of the first and second reflecting surfaces is formed based on a paraboloid surface as a reference surface.

7. The vehicle lamp according to claim 1, wherein the second reflecting surface is formed based on a paraboloid surface as a reference surface, a focal point of the paraboloid surface being at the second light emitting element.

8. The vehicle lamp according to claim 7, wherein the focal point of the paraboloid surface being at a light emitting center of the second light emitting element.

9. The vehicle lamp according to claim 1, wherein the second light emitting element is arranged to be displaced above the first light emitting element.

10. The vehicle lamp according to claim 1, wherein the second light emitting element is arranged to emit light in a direction inclined toward the front of the lamp.

* * * * *